US006108993A

United States Patent [19]

Hageman

[11] Patent Number: 6,108,993

[45] **Date of Patent: *Aug. 29, 2000**

[54] ROOF HAVING IMPROVED BASE SHEET

[75] Inventor: John P. Hageman, Closter, N.J.

[73] Assignee: Palisades Atlantic Inc., N.J.

[ * ] Notice: This patent is subject to a terminal disclaimer.

[21] Appl. No.: 09/096,204

[22] Filed: Jun. 11, 1998

Related U.S. Application Data

[63] Continuation-in-part of application No. 08/816,971, Mar. 13, 1997, Pat. No. 5,884,446.

[60] Provisional application No. 60/024,560, Aug. 26, 1996.

[51] Int. Cl.[7] ..... E04B 7/00; E04D 5/10; E04D 11/02

[52] U.S. Cl. ..... 52/408; 52/410; 52/506.05; 52/309.8; 52/746.11

[58] Field of Search ..... 52/408, 410, 309.8, 52/309.9, 309.11, 506.05, 746.11

[56] References Cited

U.S. PATENT DOCUMENTS

| | | | |
|---|---|---|---|
| 3,466,222 | 9/1969 | Curtis | 52/408 X |
| 3,694,306 | 9/1972 | Fricklas | 52/408 X |
| 3,971,184 | 7/1976 | Van Wagoner | 52/408 X |
| 4,389,826 | 6/1983 | Kelly | 52/410 |
| 4,397,126 | 8/1983 | Nelson | 52/408 X |
| 4,441,295 | 4/1984 | Kelly | 52/408 |
| 4,450,663 | 5/1984 | Watkins | 52/309.8 X |
| 4,492,064 | 1/1985 | Bynoe | 52/408 X |
| 4,521,478 | 6/1985 | Hageman | 428/287 |
| 4,525,967 | 7/1985 | Simpson | 52/410 X |
| 4,599,258 | 7/1986 | Hageman | 428/140 |
| 4,658,554 | 4/1987 | Riley et al. | 52/408 X |
| 4,669,246 | 6/1987 | Freeman | 52/408 |
| 4,670,071 | 6/1987 | Cooper et al. | 156/71 |
| 4,707,961 | 11/1987 | Nunley et al. | 52/410 X |
| 4,719,723 | 1/1988 | Van Wagoner | 52/408 X |
| 4,736,561 | 4/1988 | Lehr et al. | 52/410 |
| 4,837,095 | 6/1989 | Hageman | 428/287 |
| 4,996,812 | 3/1991 | Venable | 52/746.11 X |
| 5,088,259 | 2/1992 | Myers | 52/410 |
| 5,099,627 | 3/1992 | Coulton et al. | 52/408 |
| 5,137,764 | 8/1992 | Doyle et al. | 52/390 X |
| 5,251,416 | 10/1993 | White | 52/410 |
| 5,884,446 | 3/1999 | Hageman | 52/408 |

*Primary Examiner*—Laura A. Callo
*Attorney, Agent, or Firm*—Ostrolenk, Faber, Gerb & Soffen, LLP

[57] ABSTRACT

A roof includes a deck, an insulating layer over the deck and a base sheet comprising a laminate of aluminum and unwoven polyester overlaying the insulating layer such that the unwoven polyester layer faces the insulating layer. The base sheet and insulating layer are fastened to the deck by a plurality of mechanical fasteners. A conventional built-up roof composite, or a conventional single-ply membrane, is then formed over the base sheet.

32 Claims, 2 Drawing Sheets

ROOF HAVING IMPROVED BASE SHEET

CROSS REFERENCE TO RELATED APPLICATIONS

This application is a Continuation-In-Part of application Ser. No. 08/816,971 filed on Mar. 13, 1997 and entitled "ROOF HAVING IMPROVED BASE SHEET" now U.S. Pat. No. 5,884,446, the entire disclosure of which is incorporated by reference herein. The '971 application is based on Provisional Application Serial No. 60/024,560, filed Aug. 26, 1996 and entitled "BUILT-UP ROOFING".

BACKGROUND OF THE INVENTION

The present invention relates generally to roofs and, more particularly, to a roof having an improved base sheet.

Although the present invention is applicable to any type of roof, it has particular applicability in connection with its use in built-up and single ply roofs.

Built-up roofs are formed of alternate layers of bituminous material and felt which are assembled or "built-up" in the field. The alternate layers of bituminous material and felt are assembled onto an overlay which overlies an insulation layer. The insulation layer and overlay are attached to a roof deck which typically is made of metal, wood, concrete gypsum or any other conventional deck material.

A typical built-up roof 10, as shown in FIG. 1, may include a corrugated metal deck 11, an insulation layer 12 directly over the deck 10 and an overlay 13 over the insulation layer 12. Typically, the overlay is one-half inch thick fiberboard. Both the insulation layer 12 and the fiber board overlay 13 are fastened to the deck by mechanical fasteners 14, such as screws, which are inserted through a metal plate (not shown). A built-up roof composite 16 is then formed on the base sheet 13. Typically, the built-up roof composite 16 comprises alternate layers of felt and a bituminous material.

The term "built-up roof composite" as used herein means any one of a plurality of different conventional built-up roof composites used on the top of overlays, such as the built-up roof composite described herein, as well as others, such as EPDM, PVC, modified bitumen, coal tar and Hypolon.

The bituminous material is usually of coal tar or asphalt origin and is applied by hot-mopping between alternate layers of the felt.

The primary function of the overlay 13 is to prevent blistering of overlying layers. Additionally, the overlay 13 prevents the bituminous material from dripping into and through the deck 11. Such penetration has a number of disadvantages. First, any dripping during installation can penetrate into the underlying building, thereby causing injury to people and damage to equipment, furnishings, etc. Additionally, dripping, in the case where the underlying deck is made of wood, could also serve to attach the insulation layer 11 to the deck by means of the bituminous material, as well as the mechanical fasteners, thereby making removal of the insulation layer difficult in those situations where it is necessary to replace the roof. Further, the overlay prevents any of the overlying bitumen from passing through the deck and into any interior fire, thereby preventing any further fueling of the fire.

The function of the metal fasteners 14 is to secure the overlay 13 and the insulation layer 12 to the deck 10. Wind storms have caused more damage to roofs than any other nature related incident. Accordingly, the number of fasteners 14 employed must be sufficient to provide sufficient holding power to provide a required amount of wind uplift prevention. In the past, this has resulted in a relatively large amount of closely spaced fasteners being used, adding to the material and labor costs of roof installation.

An alternative structure to the built-up roof is a weather resistant elasto-plastic membrane which may comprise, for example reinforced polyvinyl floride, butyl rubber, vinylidene chlorides and fluorides, polyesters, polyvinyl chloride, neoprene, chlorosulfonated polyethylene, polysulfides, polyurethanes, polyepoxies, acrylates, and other materials having suitable mechanical strength and weather durability. Such structures are generally designated "single-ply roofs" because a single thickness of the weather-resistant membrane is generally sufficient, as compared with the plurality of layers of roofing felt generally required for built-up roofs. In addition to the membrane, a layer of insulating material is also generally provided between the membrane and the roof deck of the structure in single-ply roofs.

The term "roof covering" as used herein means either a built-up roof composite or a single ply membrane.

SUMMARY OF THE INVENTION

It is an object of the present invention to provide a roof which not only provides superior fire resistance and wind uplift prevention compared to prior art roofs, but is less expensive to manufacture and easier and less expensive to install.

In accordance with the present invention, the foregoing and other objects are achieved by a roof which includes a laminate comprised of metal, such as aluminum, and a fabric, such as non-woven polyester, which overlies the roof deck such that the fabric layer faces the roof deck.

In the case of a built-up roof, the metal layer serves as a fire barrier to prevent bitumen entering the underlying building and fueling a fire. Additionally, the metal layer acts as a barrier for preventing any bitumen (or other material) applied during installation from penetrating the deck and into the interior of the underlying building. Additionally, the metal layer, in the case of wood decks, prevents the roof from being adhesively attached to the deck since such adhesion could make roof replacement very costly and, in some cases, impossible.

The fabric/metal laminate is relatively thin and of lower weight compared to the half-inch fiber board normally employed as an overlay. This makes transporting, handling and installing much simpler and cheaper.

Additionally, a roof in accordance with the present invention requires fewer mechanical fasteners to achieve superior wind uplift prevention. Less fasteners results in a substantial reduction in material and installation costs.

The relativeness thinness of the fabric/metal laminate, as compared to the half-inch fiber board, also results in the sizing down of the height of the peripheral edges of the roof, thereby requiring less labor and material in providing edge detailing.

The metal layer also acts as a barrier to moisture vapor resulting from high humidity conditions in the underlying building. Moisture vapor passing into a roof could cause blistering, cracking and distortion of the roof. The metal layer prevents such moisture from reaching any of the overlying layers. In order to prevent the moisture vapor trapped by the metal vapor barrier from being trapped in the insulation layer and causing damage or lack of effectiveness thereof, it is necessary to vent such moisture vapor. To this end, in accordance with one aspect of the invention, the metal layer has embossments thereon which form channels to the edge of the roof, thereby venting any entrapped vapors.

Other features and advantages of the present invention will become apparent from the following description of the invention which refers to the accompanying drawings.

DETAILED DESCRIPTION OF THE PREFERRED EMBODIMENT(S)

Figure 2:
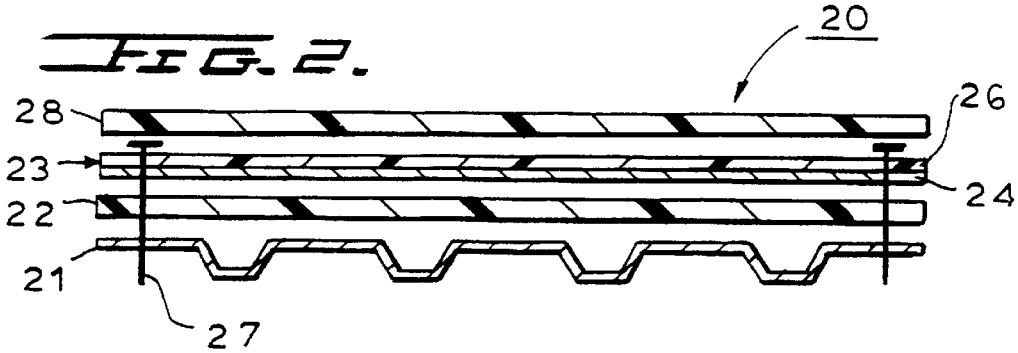
FIG. 2 is a sectional view of a roof in accordance with an embodiment of the present invention.

Referring now to the drawings and, particularly, to FIG. 2 there is shown an embodiment of a roof 20 illustrating certain features of the present invention. The roof 20 includes a deck 21 which, as shown in FIG. 2, is made of metal but which may be made of wood, concrete, gypsum or any other conventional deck material. Overlying the deck 21 is an insulation layer 22 which typically is made of any conventional roof insulating material, such as isocyanurate, polyurethane, wood fiber, fiber glass, perlite or any other lightweight insulating material. A base sheet 23 comprising a laminate of metal 24 and fabric 26 overlies the insulation layer 22. Preferably, the metal 24 is aluminum and may be 2 mils thick and the fabric 26 is a non-woven polyester having a weight ranging from 4 to 14 ounces per square yard. A polyester sheet having satisfactory properties is one made by the Hoechst Celanese Company, New Jersey and sold under the trade name of Trivera®.

Figure 1:
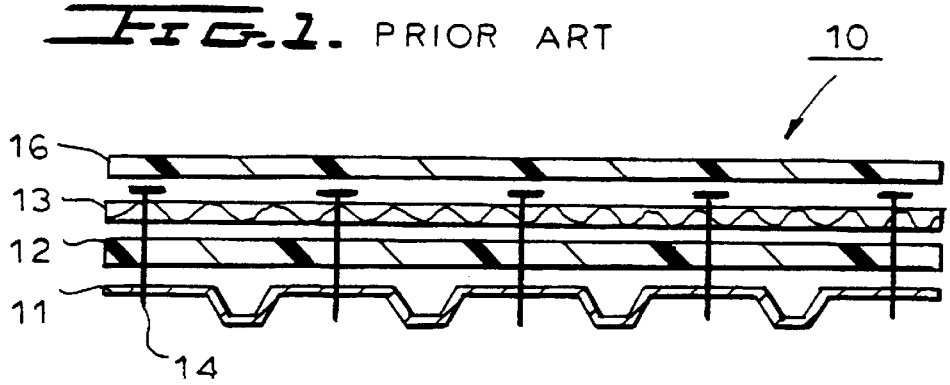
FIG. 1. PRIOR ART
FIG. 1 is a sectional view of a prior art built-up roof.

The base sheet 23 and the insulating layer 22 are attached to the deck 21 by suitable mechanical fasteners 27, such as screws or nails, which are inserted through respective metal plates (not shown). In accordance with the present invention, fewer such fasteners are necessary to attach the base sheet 23 and insulating layer 22 to the metal deck 21 to achieve a given wind-up lift prevention as compared to prior art built-up roofs, such as the prior art built-up roof of FIG. 1.

Over the base sheet 23 a conventional roof covering 28 which may be either a built-up roof composite or a single ply membrane is formed.

Typically, as discussed above, built-up roof composites are formed of alternate layers of bituminous material and felt. The felts may be fiberglass or may be organic felt, such as asphalt saturated felt or, as disclosed in U.S. Pat. Nos. 4,521,478, 4,599,258 and 4,837,095, the entire disclosures of which are incorporated by reference, the built-up roof composite 27 may be formed of alternate layers of a non-woven polyester and bituminous material. Typically, the bituminous material is usually of coal tar or asphalt origin and is applied by hot-mopping. The metal layer 24 acts as a barrier to prevent the bituminous material from penetrating down to the underlying insulation layer 22.

One of the problems with built-up roofs employing bituminous materials is that when there is an internal fire in the building, the temperatures can be such as to cause the bituminous material to liquify and penetrate through the deck into the interior, thereby feeding the fire and causing greater fire damage, as well as greater hazard to fire personnel involved in fighting the fire. Accordingly, it is necessary to provide a barrier to such bituminous liquid from entering the building. In prior art built-up roofs, the half-inch fiber board overlay 13 (FIG. 1) which, while it may char at the temperatures normally encountered, does not liquefy, is intended to prevent the overlying bituminous material from passing through the base sheet and entering the building. However, the size and weight of the fiber board base sheet precludes the sheet from being laid down as one continuous sheet. Instead, the fiber board is in the form of plurality of blocks of relatively easy to handle dimensions which are laid down side by side with seams between adjacent blocks. As a result, there is a possibility of bituminous liquid entering the building through such seams.

The laminate base sheet 23 of the present invention is similarly applied in discontinuous units such that seams are formed. However, in the present invention, not only does the metal layer 24 of the base sheet act as a fire prevention layer but, surprisingly, it has been found that the seams at the high temperatures encountered in a building fire cause melting of the overlying polyester, which then enters the seam forming a fluid type seal between adjacent metal layers 24. This seal prevents any liquid bituminous material from passing through to any of the underlying layers. Thus, the present invention provides superior fire safety features as compared to the prior art.

Figure 6:
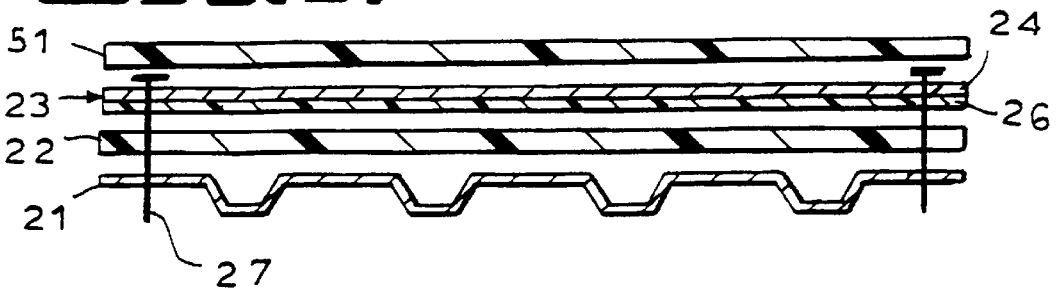
FIG. 6 is a sectional view of a single ply roof in accordance with an embodiment of the present invention.

When the roof covering is a single ply membrane, such membrane 51 (FIG. 6) preferably comprises an elasto/polymeric material. Without limitation on the generality of useful materials, the membrane may be formed of ethylene propylene diene monomer (EPDM), modified bitumen (MB), reinforced modified bitumen (MB/R), polychloroprene or neoprene (NEO), polyvinyl chloride (PVC), chlorinated polyethylene (CPE), polyisobutylene (PIB), or ethylene-copolymer-bitumen and anthracite microdust (ECB). The adhesive is chosen for its compatibility with the material comprising the membrane 51.

To install the roof 20, the insulation layer 22 is first laid over the deck 21. Typically the insulation layer 22 is laid over the deck as a plurality of individual boards. Then, the base sheet 23, which typically is supplied from rolls approximately 40" in width, is laid on the roof in strips of 40" width with overlapping seams. The metal layer 24 of the base sheet 23 may simply be glued to the polyester 26 or attached thereto by any one of a number of conventional bonding methods, except a method, such as needle punching, which creates perforations which would allow bituminous material to flow down to underlying layers, the deck and the interior of the building. The base sheet 23 and the insulation layer 22 are then attached to the deck by a plurality of mechanical fasteners 27 which may be screws, nails or, depending upon the deck, toggle bolts, or any other conventional mechanical fastener, and which are typically inserted through respective metal plates (not shown).

Thereafter, in the case where the roof covering 28 is a built-up roof composite, the built-up roof composite is formed by hot-mopping alternating layers of a hot bituminous material, such as hot asphalt, onto the base sheet 23 with intervening layers of a felt which may be a non-woven polyester or any other conventional felt material. In the case where the roof covering is a single ply membrane, the single ply membrane is applied to the base sheet 23 by a suitable adhesive Turning now to FIG. 3, an alternative embodiment of the present invention is shown which includes a base sheet 23' similar to the base sheet 23 of the first embodiment except that the metal layer 24' of the base sheet 23' has embossments 25 thereon to provide a plurality of channels 29 which serve as vents for any moisture vapors that may be present. Such moisture vapors may result from normal conditions within the building or from high humidity processes taking place within the building. In any event, moisture vapors which are not vented from the roof can cause damage to the insulation layer 22 and/or damage to the roof composite 28. The base sheet 23', because the layer 24' serves as a vapor barrier, prevents any of the moisture vapors from reaching the overlying roof covering 28, while the vents or channels 29, which are directed out to the edge of the roof, serve to vent out any moisture vapors and prevent the same from becoming trapped in the insulation 22 and adversely affecting such insulation.

Figure 3:
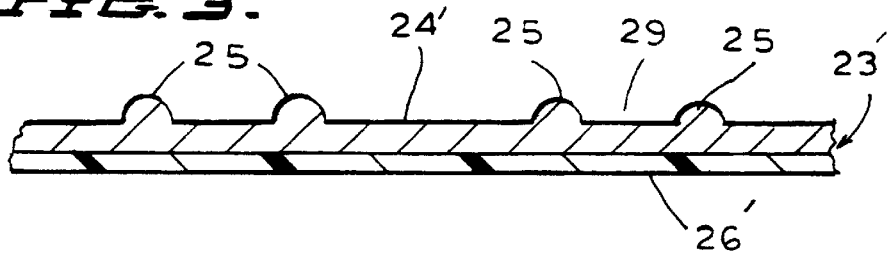
FIG. 3 is a sectional view of a first alternative embodiment of a roof in accordance with the present invention.

The embodiment of FIG. 3 may also find particular use in putting a new roof over an existing roof. When a roof has to be replaced, either the existing roof may be removed or a new roof placed over the old roof. Roofs that have to be replaced generally contain a substantial amount of residual moisture. Accordingly, placing a new roof over an existing roof requires means for venting the moisture which is retained in the old roof. This is efficaciously accomplished in accordance with the present invention by use of the base sheet 23', since the channels 29 will enable venting of any moisture resulting from the old roof.

Figure 4:
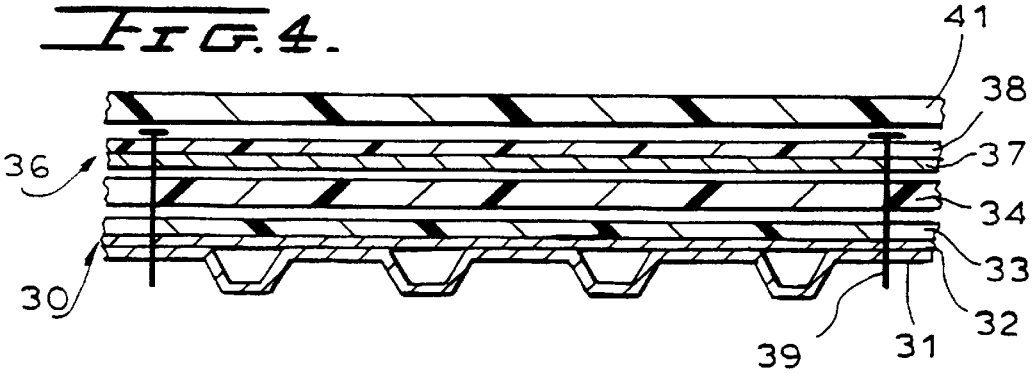
FIG. 4 is a sectional view of a second alternative embodiment of a roof in accordance with the present invention.

Certain insulation materials, which turn into a fiery liquid when subjected to high temperatures cannot be directly attached to a metal deck unless a layer of fireproofing material is placed between the deck and such material. For example, extruded or expanded polystyrene cannot be attached directly to a metal deck for this reason. Instead, a fiber board underlay which can be screwed to the metal deck is first laid down and then the expanded or extruded polystyrene applied over the fiber board. An overlay is then placed over the polystyrene. In lieu of such an arrangement, the embodiment shown in FIG. 4 may be used in which a first metal/fabric laminate 30 overlies a metal deck 31, the laminate 30 being placed over the deck 31 with the fabric layer thereof 33 in contact with the deck 31 and with the metal layer 32 facing upwardly over the laminate. An insulation layer 34 of polystyrene is then applied over the laminate 30 and a base sheet 36 similar to the sheet 23 or 23' and having a metal layer 37 and a fabric layer 38 is then placed over the polystyrene insulation layer. The layers 30, 34 and 36 are secured to the metal deck by mechanical fasteners 39. A roof covering 41 is then laid over the base sheet 36.

The number of fasteners employed in securing the base sheet to an unlying deck is a function of the hold down force required to achieve a given wind uplift prevention. Factory Mutual ("FM"), an independent testing agency, in addition to testing roofs for certain fire prevention criteria, also tests roofs to determine whether they have a desired wind uplift prevention. The tests employed by FM are designated with a particular psi (pounds per square inch) number ("FM number"). Most roofs which are required to pass an FM wind uplift prevention test are required to achieve an FM number of 90 psi. Additional wind uplift capabilities are tested for in increments of 30 psi (e.g., 120 psi, 150 psi, etc.).

There is no predetermined criteria for determining either the number of fasteners or the spacing therebetween required to achieve a particular wind uplift prevention. Accordingly, the number of and spacing between fasteners will vary from installation to installation and, in most cases, will have no correlation to an FM number.

In accordance with one aspect of the present invention, the locations of the fasteners for each FM number (e.g., 90 psi, 120 psi, etc.) are predetermined by, for example, empirical methods. Then, indicia representing the empirically determined locations to achieve each FM number are marked on the top surface of the base sheet.

Figure 5:
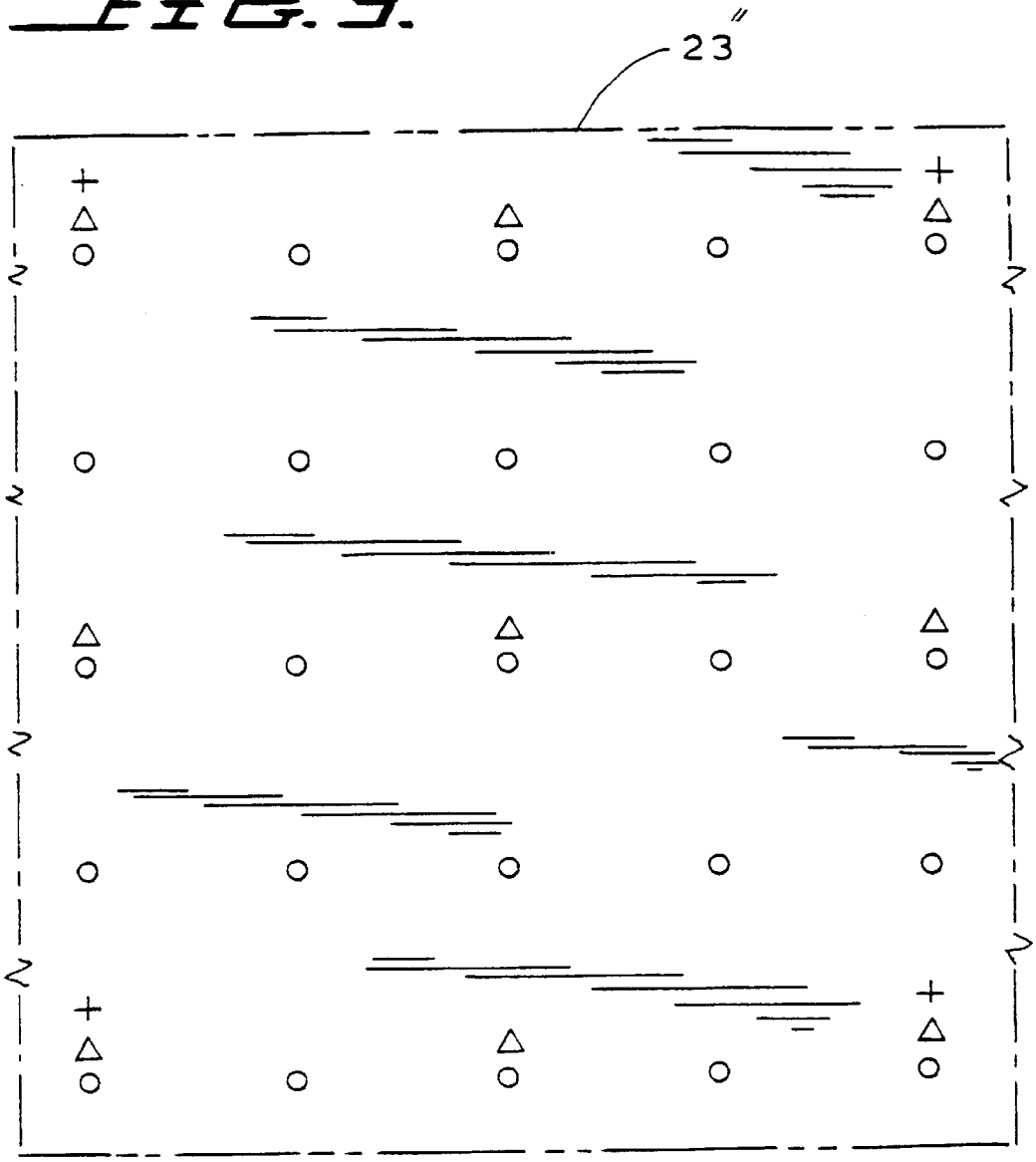
FIG. 5 is a plan view of a base sheet having different indicia for the location of fasteners.

More specifically, referring to FIG. 5, there is shown a plan view of a base sheet 23" having a plurality of different types of indicia thereon, such as crosses (+), triangles (Δ) and circles (o). Each different type of indicia represents a given FM wind number and the location of each on the base sheet represents the location in which a fastener should be inserted to achieve such FM number. In the example shown in FIG. 5, the crosses (+) represent 90 psi, the triangles (Δ) 120 psi and the circles (o) 150 psi. It will be noted that the spacing between the crosses (+) are greater than the spacing between the triangles (Δ) which in turn are greater than the spacing between the circles (o). That is, the spacing between indicia representing a lower FM psi number is greater than the spacing between indicia representing a higher FM number because the lower the FM number the less the number of fasteners required and the greater the spacing therebetween.

It should now be appreciated that the present invention provides a number of advantages as compared to prior art roofs:

1. The metal layer of the metal/fabric laminate acts as a fire barrier to prevent bitumen entering the building and fueling any fire.

2. Elimination of the fiber board layer reduces the cost of material, as well as the cost of installation.

3. The greater strength of the metal/fabric laminate base sheet provides greater wind uplift prevention and enables the use of a substantially lower number of fasteners thereby saving material and installation costs.

4. The substantially lower thickness of the metal/fabric laminate base sheet as compared to the prior art half-inch fiber board base sheet reduces the height of the side edges of the building roof. This enables substantially smaller edge detailing thereby saving additional labor and installation costs.

5. The metal layer of the metal/fabric laminate base sheet serves as a barrier to any bitumen seeping through to underlying layers, thereby enabling an old roof to be removed by simply removing the fasteners and the layers overlying the deck.

6. The sealing of adjacent seams during a fire prevents any bituminous material from entering the building and further fueling the fire.

7. The metal layer of the metal/fabric laminate serves as a vapor barrier which prevents moisture related damage to overlying layers.

8. Embossing of the metal layer of the metal/fabric laminate provides venting channels to prevent any moisture build-up in underlying layers.

The present invention thus provides a system that substantially reduces catastrophic damage resulting from both wind and fire and does so at reduced costs.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A roof comprising:

a deck; and a laminate of a metal layer and a fabric layer overlying said deck such that said fabric layer faces said deck.

2. The roof of claim 1, wherein the fabric of said fabric layer is made of plastic.

3. The roof of claim 2, wherein said plastic is non-woven polyester.

4. The roof of claim 1, wherein the metal of said metal layer is aluminum.

5. The roof of claim 1, wherein the metal of said metal layer is aluminum and the fabric of said fabric layer is made of non-woven polyester.

6. The roof of claim 1, wherein the metal layer facing away from said deck has a plurality of different type indicia thereon, each type of indicia representing the location in which a fastener needs to be inserted to achieve a desired wind uplift prevention.

7. A roof comprising:

a deck; and a laminate of a metal layer and a fabric layer overlying said deck such that said fabric layer faces said deck, wherein said metal layer has embossments thereon forming venting channels.

8. A roof comprising:

a deck;

an insulating layer overlying said deck;

a laminate of a metal layer and a fabric layer overlying said deck such that said fabric layer faces said deck;

fasteners for fastening said laminate and said insulating layer to said deck; and a roof covering overlying said laminate.

9. The roof of claim 8, wherein the fabric of the fabric layer is made of non-woven polyester.

10. The roof of claim 8, wherein the metal of said metal layer is aluminum.

11. The roof of claim 8, wherein the metal of said metal layer is aluminum and the fabric of said fabric layer is made of non-woven polyester.

12. The roof of claim 8, wherein the metal layer facing away from said deck has a plurality of different type indicia thereon, each type of indicia representing the location in which a fastener needs to be inserted to achieve a desired wind uplift prevention.

13. The roof of claim 8, wherein the roof covering is a built-up roof composite.

14. The roof of claim 8, wherein the roof covering is a single-ply membrane.

15. A roof comprising:

a deck;

an insulating layer overlying said deck;

a laminate of a metal layer and a fabric layer overlying said deck such that said fabric layer faces said deck;

fasteners for fastening said laminate and said insulating layer to said deck; and a roof covering overlying said laminate, wherein said metal layer has embossments thereon forming venting channels.

16. A roof comprising:

a deck;

a first laminate of a first metal layer and a first fabric layer overlaying said deck such that said first fabric layer faces said deck and is in contact therewith;

an insulating layer of polystyrene overlying said first laminate;

a second laminate of a second metal layer and a second fabric layer overlying said insulating layer such that said second fabric layer faces said insulating layer; and a plurality of fasteners for fastening said first and second laminates and said insulating layer to said deck.

17. The roof of claim 16, wherein the metal of said first and second metal layers of said first and second laminates is aluminum and the fabric of said fabric layers of said first and second laminates is non-woven polyester.

18. The roof of claim 17, wherein said second metal layer of the second laminate has embossments thereon forming venting channels.

19. The roof of claim 16, further comprising a built-roof composite overlying said second laminate.

20. The roof of claim 16, wherein the second metal layer facing away from said deck has a plurality of different type indicia thereon, each type of indicia representing the location in which a fastener needs to be inserted to achieve a desired wind uplift prevention.

21. A method of forming a roof on a deck comprising:

placing an insulating layer over said deck;

placing a laminate of a metal layer and a fabric layer over said deck such that said fabric layer faces said deck; and fastening said laminate and said insulating layer to said deck.

22. The method of claim 21, wherein the metal of said metal layer is aluminum and the fabric of said fabric layer is made of non-woven polyester.

23. The method of claim 21, further comprising applying a built-up roof composite over said laminate.

24. The method of claim 21, further comprising applying a single-ply membrane over said laminate.

25. The method of claim 21, wherein the metal layer on the side facing away from the deck has a plurality of different types of indicia, each type of indicia representing a different wind uplift prevention, and wherein the step of fastening said laminate and said insulating layer to said deck includes inserting fasteners through said laminate and said insulating layer to said deck at locations corresponding to the location of the types of indicia representing a desired wind uplift prevention.

26. A method of forming a roof on a deck comprising:

placing an insulating layer over said deck;

placing a laminate of a metal layer and a fabric layer over said deck such that said fabric layer faces said deck; and fastening said laminate and said insulating layer to said deck, wherein said metal layer has embossments thereon forming venting channels.

27. A method of forming a roof on a deck, comprising:

placing a first laminate of a first metal layer and a first fabric layer over said deck such that said first fabric layer faces said deck and is in contact therewith;

applying an insulating layer of polystyrene over said first laminate;

placing a second laminate of a second metal layer and a second fabric layer over said insulating layer such that said second fabric layer faces said insulating layer; and fastening said first and second laminates to said deck such that said insulating layer is secured within said first and second laminates.

28. The method of claim 27, wherein the metal of said first and second metal layers of said first and second laminates is aluminum and the fabric of said first and second laminates is non-woven polyester.

29. The method of claim 27, further comprising applying a built-roof composite over said second laminate.

30. The method of claim 27, further comprising applying a single-ply membrane over said second laminate.

31. The method of claim 27, wherein the second metal layer on the side facing away from the deck has a plurality of different types of indicia, each type of indicia representing a different wind uplift prevention, and wherein the step of fastening said first and second laminates and said insulation layer to said deck includes inserting fasteners through said first and second laminates and said insulation layer to said deck at locations corresponding to the location of the types of indicia representing a desired wind uplift prevention.

32. A roof comprising:

a deck;

an insulating layer overlying said deck;

a laminate of a metal layer and a fabric layer overlying said deck such that said fabric layer faces said deck;

fasteners for fastening said laminate and said insulating layer to said deck; and a roof covering overlying said laminate, wherein said second metal layer of the second laminate has embossments thereon forming venting channels.

* * * * *